US006157356A

United States Patent [19]

Troutman

[11] Patent Number: 6,157,356

[45] Date of Patent: Dec. 5, 2000

[54] DIGITALLY DRIVEN GRAY SCALE OPERATION OF ACTIVE MATRIX OLED DISPLAYS

[75] Inventor: Ronald Roy Troutman, Ridgefield, Conn.

[73] Assignee: International Business Machines Company, Armonk, N.Y.

[21] Appl. No.: 08/631,350

[22] Filed: Apr. 12, 1996

[51] Int. Cl.[7] ..... G09G 3/32

[52] U.S. Cl. ..... 345/82; 345/147; 345/148; 345/205; 345/206

[58] Field of Search ..... 345/205, 206, 345/82, 147, 148, 169.3; 315/169.3

[56] References Cited

U.S. PATENT DOCUMENTS

| | | | |
|---|---|---|---|
| 4,621,260 | 11/1986 | Suzuki et al. | 345/92 |
| 4,996,523 | 2/1991 | Bell et al. | 345/77 |
| 5,276,380 | 1/1994 | Tang | 313/504 |
| 5,294,869 | 3/1994 | Tang et al. | 313/504 |
| 5,294,870 | 3/1994 | Tang et al. | 313/504 |
| 5,349,366 | 9/1994 | Yamazaki et al. | 345/92 |
| 5,648,792 | 7/1997 | Sato et al. | 345/92 |
| 5,748,160 | 5/1998 | Shieh et al. | 345/82 |
| 5,751,261 | 5/1998 | Zavracky et al. | 345/55 |
| 5,867,138 | 2/1999 | Moon | 345/92 |

OTHER PUBLICATIONS

C.W. Tang and S.A. VanSlyke, "Organic El Diodes", Appl. Phys. Lett., vol. 51, pp. 913–915, Sep. 1987.

C.W. Tang, S.A. Van Slyke and C.H. Chen, "Electroluminescence of Doped Organic Thin Films", J. Appl. Phys., vol. 65, pp. 3610–3616, May 1989.

*Primary Examiner*—William A. Cuchlinski, Jr.
*Assistant Examiner*—Marthe Marc-Coleman
*Attorney, Agent, or Firm*—Thomas A. Beck; Daniel P. Morris

[57] ABSTRACT

Disclosed is a pixel circuit consisting of MOS field-effect transistors (or of thin-film transistors), a capacitor, and an organic light-emitting diode that stores a voltage signal that is used to control the amount of light emitted from the pixel. This pixel circuit is used in a two-dimensional array to form an active-matrix OLED display. The amount of light emitted at each pixel during a frame time is controlled by dividing the frame time into many sub-frames and changing the stored voltage at the beginning of each sub-frame in such a way that the integrated time a voltage is stored during a frame time determines the total amount of light emitted.

20 Claims, 4 Drawing Sheets

DIGITALLY DRIVEN GRAY SCALE OPERATION OF ACTIVE MATRIX OLED DISPLAYS

FIELD OF THE INVENTION

The invention relates to a pixel circuit that enables gray scale operation of an active matrix display using organic light emitting diodes.

BACKGROUND

References (1,2,3) teach the layout and related fabrication steps for a passive matrix OLED display. However, in passive matrix operation a given pixel emits light only during a line time. In a VGA display, for example, this translates to an optical duty factor of only 1/480=0.21%. To compensate, the pixel must emit 480 times as much light as a pixel that emits constantly. The disadvantages of such operation are (a) higher voltage with attendant higher power, (b) operation at sub-optimum levels of electrical/optical conversion efficiency, (c) possible visual artifacts, and (d) faster degradation of the display. An active matrix OLED display would solve these problems.

Reference (4) teaches a pixel circuit designed for gray scale operation in an active matrix OLED display. This circuit stores the n bits of gray scale in n memory elements at each pixel. However, this circuit requires at least 6n+2 MOS transistors and n column lines, per pixel. Such a circuit would be much too large for use in a practical display. What is needed is a much simpler circuit.

1. U.S. Pat. No. 5,276,380—"Organic EL Image Display Device," C. Tang, Jan. 4, 1994.

2. U.S. Pat. No. 5,294,869—"Organic EL Multicolor Image Display Device," C. Tang and J. Littman, Mar. 15, 1994.

3. U.S. Pat. No. 5,294,870—"Organic EL Multicolor Image Display Device," C. Tang, D. Williams, and J. Chang, Mar. 15, 1994.

4. U.S. Pat. No. 4,996,523—"EL Storage Display with Improved Intensity Driver Circuits," C. S. Bell and M. J. Gaboury, Feb. 26, 1991.

C. W. Tang and S. A. VanSlyke, "Organic EL Diodes," Appl. Phys. Lett. vol. 51, pp. 913–915 (Sep. 21, 1987).

C. W. Tang, S. A. Van Slyke, and C. H. Chen, "Electroluminescence of Doped Organic Thin Films," J. Appl. Phys., vol. 65, pp. 3610–3616 (May 1, 1989).

SUMMARY

This disclosure teaches a simple pixel circuit for achieving active matrix operation in an OLED display. It also teaches how such a pixel circuit can be digitally driven to achieve gray-scale operation of the display.

DETAILED DESCRIPTION

Figure 1A:
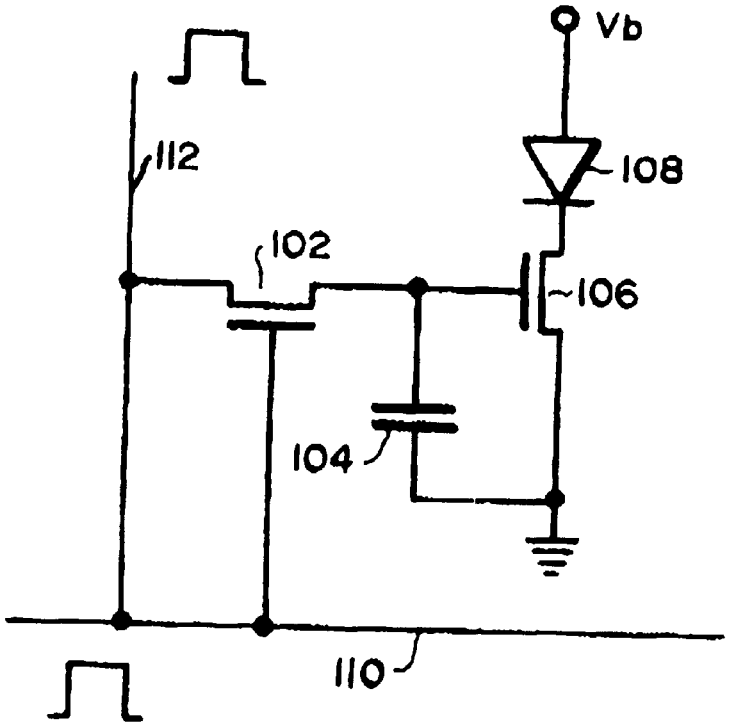
FIG. 1A is the preferred embodiment of the pixel circuit. The access device 102 and the current control device 106 are both N-channel MOSFETs or TFTs, and the OLED 108 is in the common anode configuration.

FIG. 1A shows the preferred embodiment of the pixel circuit. The access device 102 is used to place a voltage on capacitor 104. If this voltage exceeds the threshold voltage of device 106, both it and the organic light-emitting diode (OLED) 108 conduct current, and light is emitted from OLED 108. In this particular embodiment, devices 102 and 106 are N-channel metal-oxide-semiconductor field-effect transistors (MOSFETs) or N-channel thin-film transistors (TFTs), and OLED 108 has a common anode configuration. The bias voltage $V_b$ is applied to all diodes in the display.

Figure 1B:
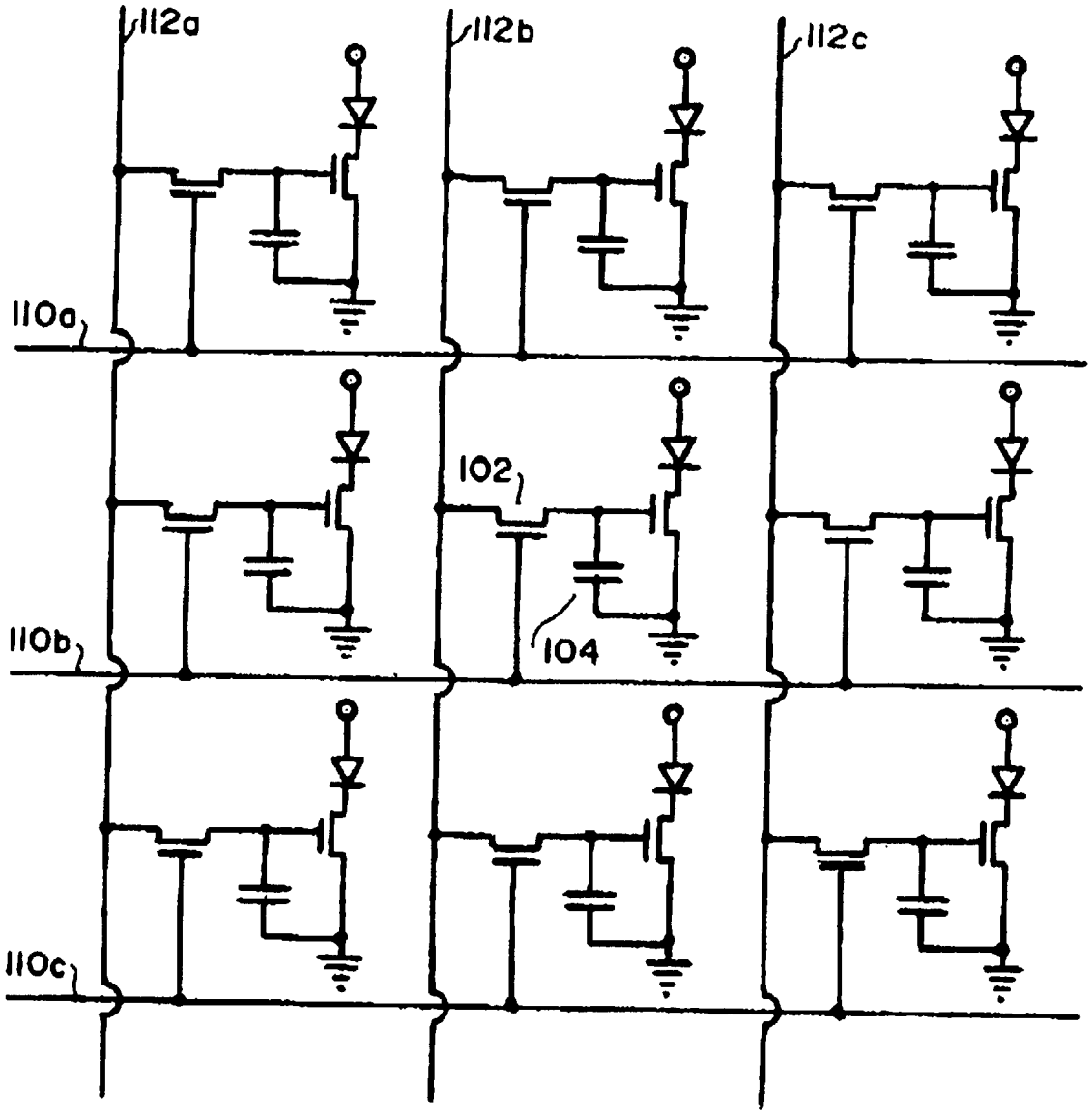
FIG. 1B is a two-dimensional array of the pixel circuit showing how the active matrix OLED display is formed.

An active matrix display is created by building a two-dimensional array of pixels using the two transistor pixel circuit shown in FIG. 1A. The result is indicated by the 3×3 array shown in FIG. 1B. A particular pixel is addressed by choosing the row line 110*b* and the column line 112*b*. When the row line is activated, transistor 102 is turned on, and the voltage on column line 112*b* is transferred to the capacitor 104. When the row line is de-activated, the voltage is held on capacitor 104 until the same row line is again activated. Usually the pixels along an entire row line 110*b* are written at one time by placing the appropriate voltage on all of the column lines in the array (112*a*, 112*b*, 112*c*, etc.) during a line time.

Figure 2:
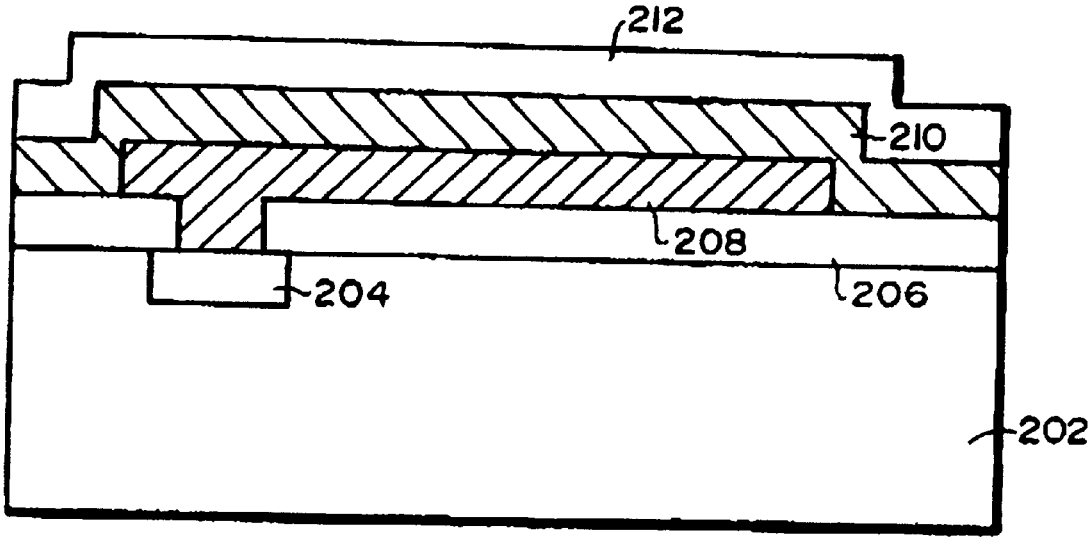
FIG. 2 shows a simplified cross section when the pixel circuit is implemented on a silicon substrate. In this case the access device and the current control devices are MOSFETs.

The pixel circuit of FIG. 1 can be implemented in many ways. In the preferred embodiment the access transistor and current control transistor are MOSFETs fabricated according to well known techniques practiced in the integrated circuit industry. The relevant cross section is shown in FIG. 2. As part of such a silicon IC process the diffusion 204 is formed in a silicon substrate of the opposite type (202). An insulating film 206 is formed over the substrate and a contact hole is etched through the insulating film, permitting contact of the metal film 208 with the diffusion. This metal film is etched into patterns, forming one electrode of the OLEDs. Then the organic films 210 are thermally evaporated as discussed in references (5,6). Finally, transparent conductive film 212 (such as ITO) is deposited to form the common electrode.

Figure 3:
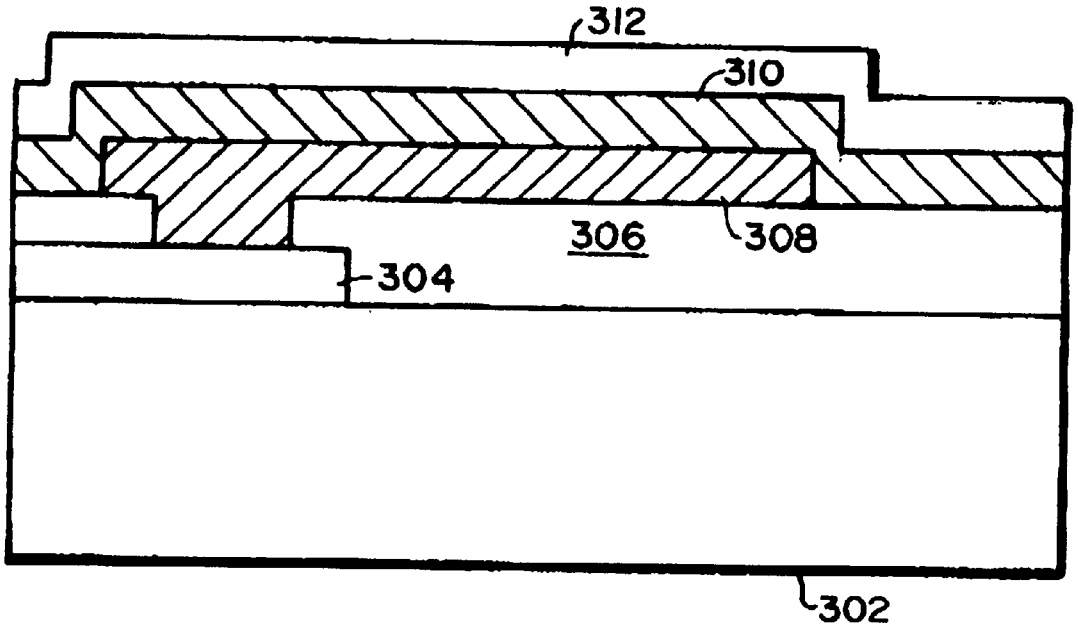
FIG. 3 shows the relevant cross section when the pixel circuit is implemented on a glass substrate. In this case the access device and the current control devices are either amorphous or polycrystalline silicon TFTs.

In another embodiment the access transistor and current control transistor are amorphous or polycrystalline thin-film transistors fabricated according to well known techniques practiced in the display industry for active matrix liquid-crystal displays. FIG. 3 shows a relevant cross section. As part of that process a highly conductive polycrystalline region 304 is formed on a glass substrate 302. Then an insulating layer 306 is formed and a contact hole etched, allowing the metal film 308 to contact region 304. Next the organic film layers 310 are thermally evaporated as discussed in references (5,6). Finally the transparent conductive film 312 is deposited to form the common electrode.

Gray-scale operation of the display is accomplished by dividing the frame time $T_f$ into multiple sub-frames $T_{sfk}$ and addressing all row lines during each sub-frame time. Each column line is either $V_h$ or $V_l$ during the line time, and this voltage is written into the storage capacitor 104 of all pixels along the activated row line. Common values are $V_l$=0 and $V_h>V_t$, where $V_t$ is the threshold of transistor 106. $V_h$ is chosen sufficiently greater than $V_t$ so that the ON impedance of transistor 106 is negligible compared to the diode impedance. When $V_l$ is stored on capacitor 104 during a frame time, no current flows through the OLED 108, and no light is emitted. When $V_h$ is stored, transistor 106 is turned on and OLED 108 conduct s current, generating light. The maximum intensity of light is chosen by setting the bias voltage $V_b$.

For n bits of gray scale there are n sub-frames, and the sum of all sub-frame times equals the frame time $T_f$. A pixel's luminance is proportional to the sub-frame time, and each of the sub-frame times is weighted to produce the $2^n$ gray scale levels. Various weightings are possible and a binary weighting algorithm is discussed below.

For a display with M rows and N columns, each sub-frame requires M×N bits of data, and these are stored in a buffer memory. For each row line access, N bits are read from the buffer memory and written to the N storage capacitors on the accessed row line, and this is continued until all row lines have been accessed. The time required to transfer all M×N bits is the write time $T_w$, and this time must be less than the sub-frame time for the least significant bit. Under this condition the length of time a signal is stored is equal to the sub-frame time for every pixel in the display.

Several possibilities exist for presenting the n bits to a pixel. One possible ordering is to read the least significant bit first and to weight the first sub-frame time as $T_{sf1}/T_f=1/(2^n-1)$, followed by the second-least significant bit and weighting the second sub-frame time $T_{sf2}/T_f=2/(2^n-1)$, and so on until the most significant bit is reached, and its sub-frame weighting is $T_{sfn}/T_f=2^{n-1}/(2^n-1)$. With n=4, for example, the weightings are 1/15, 2/15, 4/15, and 8/15.

Another possible ordering is to present the most significant bit first, followed by the second-most significant bit, etc., until the least significant bit is reached. Still other orderings are possible, in which the bit ordering is chosen to avoid visual artifacts if they exist.

As an example of how data is written to the pixel capacitors, consider a display with n=4 bits of gray scale and a 60 Hz refresh rate. The frame time is then 16.67 ms, and the sub-frame time for the least significant bit is 16.67/15=1.11 ms. During a write time $T_w$<1.11 ms, the least significant gray scale bit is written into all pixels. At the end of 1.11 ms the second-least significant bit is written into all pixels, again requiring a time $T_w$. The sub-frame time for this bit 16.67(2/15)=2.22 ms, and after this time the third-least significant bit is written into all pixels. This data transfer from the buffer memory to the pixels continues until the end of the sub-frame for the most significant bit, at which time the least significant bit for the next frame is transferred.

If a separate buffer memory is used for each sub-frame, then n buffer memories are required. After the data from one buffer is transferred to the display, new data can be entered into that buffer as preparation for the next data transfer to the display, insuring continuous flow of data to the display without any dead time. This can also be accomplished by a single buffer memory having simultaneous read/write capability.

Figure 4:
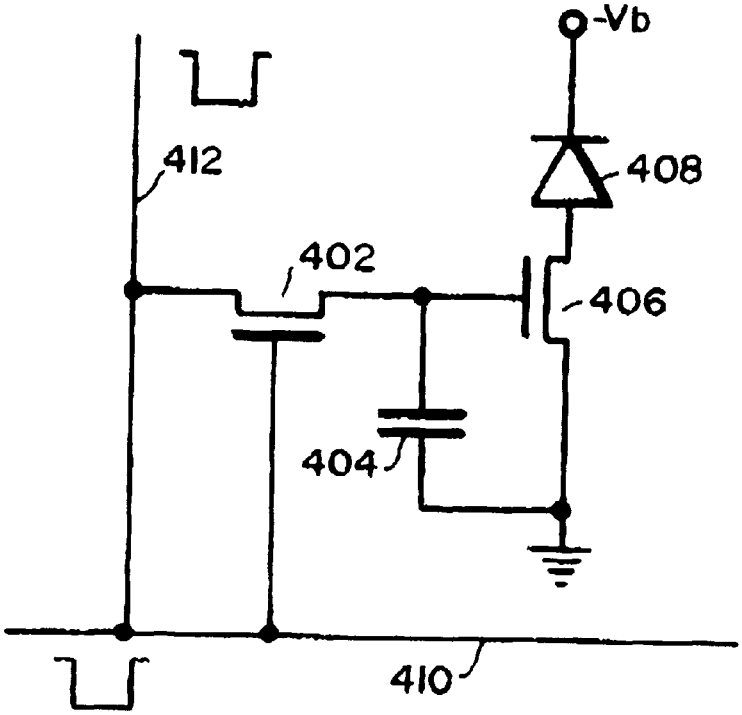
FIG. 4 is an alternative embodiment of the pixel circuit in which access device 402 and current control device 406 are both P-channel MOSFETs or TFTs, and the OLED 408 is in the common cathode configuration.

FIG. 1A shows a pixel circuit using two N-channel MOSFETs or TFTs for the access and current control transistors and a common anode OLED. Alternatively, the complementary circuit in FIG. 4 can be used with a common cathode OLED 408. Now the access and control transistors both are P-channel FETs or TFTs, and the row and column lines operate with negative polarity pulses. The bias voltage $V_b$ is also negative.

Figure 5:
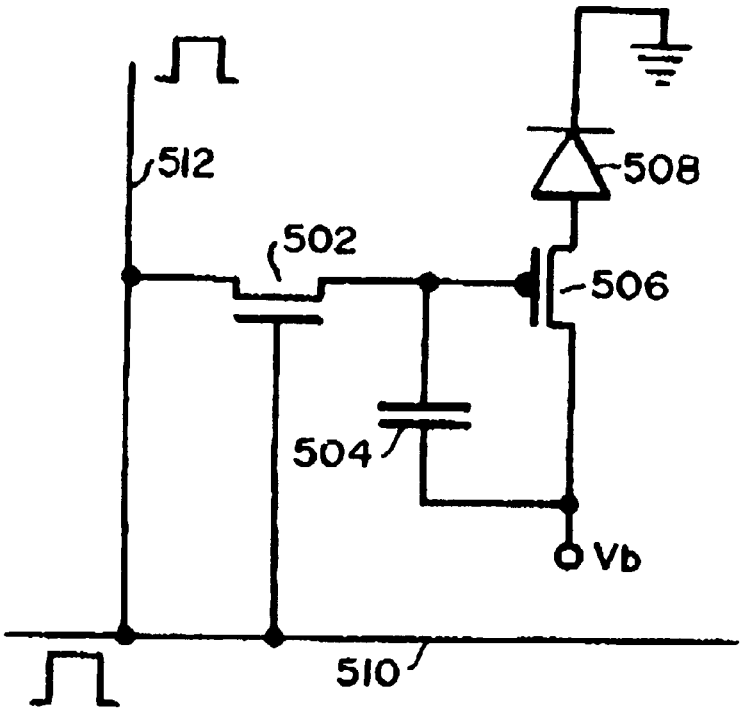
FIG. 5 is an alternative embodiment of the pixel circuit in which the access device 502 is an N-channel MOSFET or TFT and the current control device 506 is a P-channel MOSFET or TFT. The OLED 508 is in the common cathode configuration.

Another alternative for the common cathode OLED is shown in FIG. 5. This embodiment retains an N-channel MOSFET for the access transistor and a positive polarity for the row and column pulses. Now the roles of the $V_h$ and $V_l$ pulses are reversed i.e., the OLED 508 emits light when $V_l$ is stored on capacitor 504 and is dark when $V_h \cong V_b$ is stored on capacitor 504.

Figure 6:
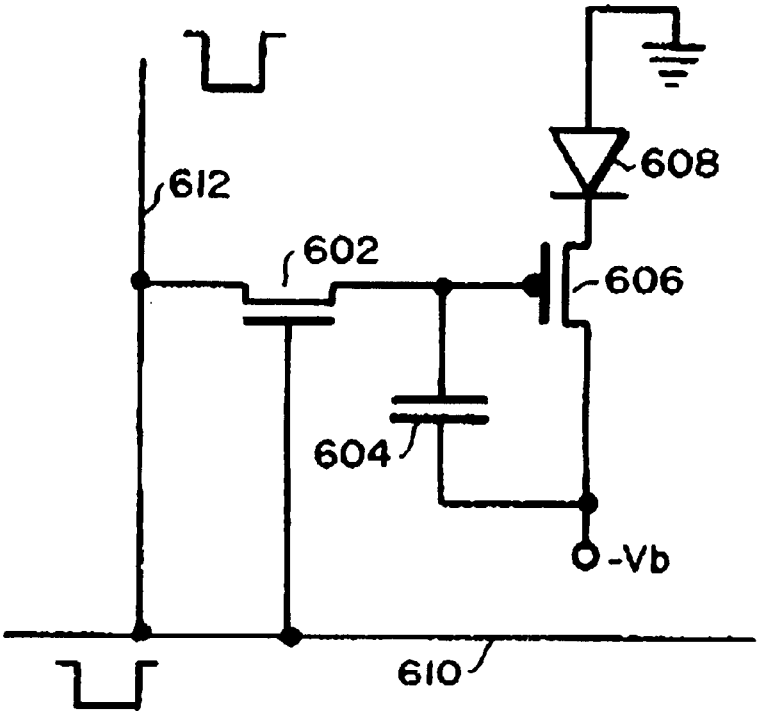
FIG. 6 is an alternative embodiment of the pixel circuit in which the access device 602 is an P-channel MOSFET or TFT and the current control device 606 is a N-channel MOSFET or TFT. The OLED 608 is in the common anode configuration.

The fourth embodiment, shown in FIG. 6, is the complementary circuit to that shown in FIG. 5. The row and column pulses are of negatively polarity, as is the bias voltage. The access transistor is a P-channel MOSFET or TFT and the current control transistor is an N-channel MOSFET or TFT. The OLED 608 emits light when $V_l$=0 is stored on capacitor 604 and is dark when $|V_h| \cong |V_b|$ is stored on capacitor 604.

The above descriptions are given by way of example only and are not intended to limit the scope of the present invention in any way except as set forth in the following claims.

What is claimed is:

1. In an active matrix organic light-emitting diode (OLED) display, a pixel circuit that stores a signal voltage that contains the gray scale information generated by an access transistor device by selectively addressing a row and a column line in said display and transferring said signal voltage that contains said gray scale information from said column line to a capacitance by means of a transfer device, thereby regulating current through a control single diode transistor device driven in saturation as a current source through said OLED, thereby controlling the amount of said current and resulting light emitted from the OLED, said transfer device and said control device being a semiconductor selected from the group consisting of a MOSFET and a thin film transistor.

2. The pixel circuit in claim 1 in which the transfer device and control device are MOSFETs fabricated in a silicon substrate.

3. The pixel circuit in claim 1 in which the transfer device and control device are polycrystalline silicon TFTs fabricated on a glass substrate.

4. The pixel circuit in claim 1 in which the transfer device and control device are amorphous silicon TFTs fabricated on a glass substrate.

5. The pixel circuit in claim 1 in which the access device is an N-channel MOSFET and the control device is also an N-channel MOSFET.

6. The pixel circuit in claim 1 in which the access device is a P-channel MOSFET and the control device is also a P-channel MOSFET.

7. The pixel circuit in claim 1 in which the access device is an N-channel MOSFET and the control device is a P-channel MOSFET.

8. The pixel circuit in claim 6 or 7 in which the N-channel and P-channel MOSFETs are fabricated in single crystal silicon and the OLED is fabricated on top of the pixel circuit with its cathode electrically connected to the drain of the P-channel MOSFET.

9. The pixel circuit in claim 1 in which the access device is a P-channel MOSFET and the control device is an N-channel MOSFET.

10. The pixel circuit in claim 5 or 8 in which the N-channel and P-channel MOSFETs are fabricated in single crystal silicon and the OLED is fabricated on top of the pixel circuit with its cathode electrically connected to the drain of the N-channel MOSFET.

11. The pixel circuit in claim 1 in which the access device is an N-channel TFT and the control device is also an N-channel TFT.

12. The pixel circuit in claim 1 in which the access device is a P-channel TFT and the control device is also a P-channel TFT.

13. The pixel circuit in claim 12 or 14 in which the N-channel and P-channel TFTs are fabricated using amorphous or polycrystalline silicon deposited on a glass substrate and the OLED is fabricated on top of the pixel circuit with its anode electrically connected to the drain of the P-channel TFT.

14. The pixel circuit in claim 1 in which the access device is an N-channel TFT and the control device is a P-channel TFT.

15. The pixel circuit in claim 1 in which the access device is a P-channel TFT and the control device is an N-channel TFT.

16. The pixel circuit in claim 11 or 15 in which the N-channel and P-channel TFTs are fabricated using amorphous or polycrystalline silicon deposited on a glass substrate and the OLED is fabricated on top of the pixel circuit with its cathode electrically connected to the drain of the N-channel TFT.

17. A means of producing gray scale in a display using the pixel circuit of claim 1 in which the OLED is turned on for only a portion of the frame time, this portion being adjusted to provide the desired gray level.

18. The means for producing gray scale operation described in claim 17 whereby the frame time is divided into sub-frames and each OLED is turned on during some sub-frames and not others in such a way to achieve gray scale operation.

19. The means described in claim 18 in which the duration of the sub-frames are chosed according to a binary weighting.

20. The means described in claim 19 in which the binary weighting is done according to the formula $T_{sfk}/T_f=2^{k-1}/(2^n-1)$, where $T_{sfk}$ is the time duration of sub-frame k, $T_f$ is the frame time of the display, and n is the number of gray scale bits.

* * * * *